United States Patent [19]

Schmidt

[11] Patent Number: 4,802,307

[45] Date of Patent: Feb. 7, 1989

[54] TILT-SLIDING MECHANISM FOR A WINDOW OR DOOR

[75] Inventor: Karl H. Schmidt, Wilnsdorf-Niederdelfen, German Democratic Rep.

[73] Assignee: Siegenia-Frank KG, Siegen, Fed. Rep. of Germany

[21] Appl. No.: 175,923

[22] Filed: Mar. 31, 1988

[30] Foreign Application Priority Data

Apr. 2, 1987 [DE] Fed. Rep. of Germany ..... 3711170

[51] Int. Cl.[4] ..... E05D 15/10

[52] U.S. Cl. ..... 49/219; 49/223; 49/130

[58] Field of Search ..... 49/128, 209, 218, 219, 49/220, 129, 130, 223, 224, 221

[56] References Cited

U.S. PATENT DOCUMENTS 2,741,807 4/1956 Powers .
4,551,945 11/1985 Resch ..... 49/130
4,562,667 1/1986 Resch ..... 49/209
4,668,008 5/1987 Stinson ..... 49/219

FOREIGN PATENT DOCUMENTS 3638356 1/1988 Fed. Rep. of Germany .
3643964 2/1988 Fed. Rep. of Germany .
1551381 11/1968 France .

*Primary Examiner*—Kenneth J. Dorner
*Assistant Examiner*—Gerald A. Anderson
*Attorney, Agent, or Firm*—Blodgett & Blodgett

[57] ABSTRACT

Tilt-slide mechanism for moving a wing of a window or door to a parallel stop position and in this position for shifting it horizontally. The mechanism has lower and upper shift arms, wherein the lower arms 10 are in each case pivotally mounted (on the one hand) on the lower transverse wing beam and (on the other hand) on a traveling carriage. A releasable blocking device is provided for the lower shift arms when they are located in the parallel position. The blocking device consists of a two-armed hinged supporting lever and a guide pivot pin; its lower arm is shiftable along a guide slot on the wing. The guide pivot pin of the supporting lever combines with a detent recess to join the guide slot on the wing to the blocking device for fixing the lower shift arm relative to the wing in the parallel stop position. Further, the supporting lever has a pivot pin on its lever arm which interacts with a thrust bearing on the frame, whereby the blocking device can be released by the shift-and-stop movement of the wing from the blocking mode.

12 Claims, 5 Drawing Sheets

TILT-SLIDING MECHANISM FOR A WINDOW OR DOOR

SUMMARY OF THE INVENTION

The invention relates to a tilt-slide mechanism for a wing of a widow or door, which wing is movable to a parallel position and, in this position, is horizontally shiftable. The mechanism is provided with lower shift arms and upper shift arms. At least one of the lower shift arms is pivotally connected at one end to a traveling carriage. A releasable blocking device for at least one of the lower shift arms is located in a parallel stop position. The blocking device consists of a supporting lever located in the region of the one of the traveling carriages (on the one hand), and can be brought (on the other hand) in and out of operating connection through a control stud with a thrust bearing on the stationary frame by means of the displacement movement of the wing.

Fittings of this type for movement of windows and doors to a parallel stop position and in this position for horizontal shifting are known in the U.S. Pat. No. 2,741,807 and the FR Pat. No. 1,551,318. Their advantage resides in that, because of their structurally simple construction, they are rugged in use and can, therefore, also be used where heavy wings are to be brought into a parallel stop position relative to the stationary frame and then horizontally shifted.

The design principles of these prior art fittings are such that the supporting lever, forming the releasable blocking device, must in each case interact across the entire length of the horizontal slide path for the wing with a frame-side or stationary thrust bearing if the parallel stop position of the shift arms is to remain fixed in any possible shift position.

In the fittings shown in the U.S. Pat. No. 2,741,807, the supporting lever has to occupy (because of its swivel seating arranged at the wing in alignment with the shift arm) in its work condition at least a work position directed approximately transversely of the plane of the stationary frame and of the wing. If the fitting is to ensure the desired stop effect, the supporting lever can in its work position occupy on the fittings, according to FR Pat. No. 1,551,381 a relatively flat, angle of inclination between wing and stationary frame. The supporting lever is mounted on the traveling carriage and its control journal is permanently in sliding engagement with the guide rail for traveling carriage until the wing reaches the shift and lock position. Only at that point does the contrajournal (and thereby the supporting lever for the shift arms) become free, so that the wing can subsequently be shifted by means of the shift arm to its closing position at the stationary frame.

Fittings of this kind have also been proposed on which the shift arms of the tilt-slide device are reliably fixed through the releasable locking device in their parallel tilt-slide position, when the thrust bearing in operative connection with the control journal of the supporting lever is provided only in the region of the shift & lock position of the wing at the stationary frame.

In German Patent Application No. P3638 356.2-23 the supporting lever consists of a two-armed lever exclusively swingably mounted on the traveling carriage; the lever carries the control journal at the end of the lever arm extending towards the stationary frame, while the lever arm facing towards the shift arm is swingably hinged only to a connecting link which likewise is swingably hinged only to the shift arm.

The connecting link and the lever arm of the supporting lever engaging it form together a toggle joint which is convertible through the control journal of the supporting lever and the frame-side thrust bearing by means of the shift and lock position of the wing automatically at least from a stretching position blocking the parallel arresting position of the one or the several shift arms between the traveling carriage and the shift arm into a kink position which releases it.

The advantage of this development resides in that an inadvertent and undesirable releasing of the stop device up to attainment of the shift and lock motion of the wing through objects which reside in the path of motion of the supporting lever is effectively prevented, because the blocking device has only swivel joints which lie in staggered relation to one another in the shift and lock motion path of the wing and can, therefore, only be influenced by existing impediments in the blocking sense.

In German Patent Application No. P3643964.9 the connecting link is additionally designed as a two-armed lever, whereby its lever arm projecting beyond the joint with the shift arm operates through a pin that is swingably movable in a guide slot located at the wing, which slot is provided at its end associated with the parallel stop position of the wing with a detent recess to receive the pin.

In the parallel stop position of the wing the lever arm of the connecting link that projects beyond the joint at the shift arm acts as an additional supporting element which operates counter to an angular distortion of the wing-side bearing site of the shift arm and, therefore, considerably improves the holding function of the shift device.

The object of the invention is to simplify the kinematic construction of the lock device interacting with the tilt-slide mechanism while retaining the high functional reliability of the previously-described fitting.

This object is achieved, according to the invention, through the characterizing features, namely in that the supporting lever is an exclusively swingably hinged, two-armed lever at the shift arm in the range between the pivot point at the traveling carriage and the pivot point at the wing; this supporting lever engages in a swingably shiftable manner with a pivot pin carried at the end of the lever arm in a guide slot located at the wing. This slot is provided at the end associated with the parallel stop position of the wing with a detent recess for the pin. The end of the lever arm extending toward the traveling carriage is provided with a control journal which (through the shift-and-lock movement of the wing) can be brought into operative connection with a thrust bearing mounted on the stationary frame and which journal is lockable in a stop engagement position relative to the traveling carriage by means of the guide slot.

This development of the stop device is thereby simplified, since it does not use (on the one hand) an angular lever swingably mounted only to the traveling carriage and since (on the other hand) the frame side thrust bearing operates without a guide curve mounted with spacing in front of its catch claw for the actuation of the angular lever.

It has proved to be particularly desirable if the wing-side catch of the guide slot is formed with a bent position relative to the traveling carriage or the stationary frame and if its end section extends at an acute angle of incline relative to the main direction of the guide slot.

Another important improvement feature of the invention resides in the fact that the thrust on the frame bearing has an entrance opening for the control journal which joins a bent curve slot in the shift-and-lock position of the wing relative to the stationary frame.

When the supporting lever is located (on the one hand) with the pin sitting with its wing-side lever arm at the end of the guide slot away from the wing-side catch and (on the other hand) engages in the curved slot of the frame-side thrust bearing with its pin located at its frame-side lever arm, then the wing is blocked by the shift device and the blocking device at the stationary frame to prevent a displacement motion out of the locked position.

However, when the pin located at the wing-side lever arm of the supporting lever comes into the catch at an acute angle from the other end of the guide slot, this simultaneously places the pin mounted at the frame-side lever arm of the supporting lever into the range of the entrance opening of the frame-side thrust bearing. In this way, the wing is located in its parallel stop position and can be shifted horizontally relative to the stationary frame, while the shift position is fixed in this parallel rest position against the wing.

When it is desired to bring the wing from its closed position into a tilted, open position, it is found to be important that the wing be fixable with its horizontal beam located adjacent to the traveling carriage and relative to the stationary frame to prevent any motion transversely of its plane by means of a locking apparatus.

Since in this case the tilt-slide mechanism and the associated blocking device cannot spread between wing and stationary frame, the blocking device together with the frame-side thrust bearing bring about a detention of the wing against an undesirable horizontaly displacement.

In order that at the end of the parallel stop motion of the wing the blocking device between the wing and the shift arm come automatically into operative position, the two-armed lever is braced against the shift arm by means of a spring element which is prestressed only shortly before reaching the spreading position. The spring element is preferably formed as a leaf spring which sits adjacent the pivot point of the two-armed lever on the shift arm; this acts upon the lever arm of the supporting lever facing towards the frame.

For a durable, trouble-free interaction of the blocking device with the wing, the shift arm, and the stationary frame, it is advantageous that the wing-side bearing block for the shift arm consists of a tubular closure with an extrusion profile. The block is formed on its lower longitudinal side an undercut, one-sided open channel into which can be inserted a plate containing the guide slot for the two-armed lever of the blocking device. It is also important that the plate containing the guide slot be clamped in the channel to prevent longitudinal displacement.

A developing refinement feature of the invention resides in the fact that the extrusion profile forming the bearing block for the shift arm displays at its one end a relief which penetrates the rear profile wall. Into the relief extends a transverse leg of U-shaped cross-section which can be connected by riveting or threading to the extrusion profile.

A bushing containing an axial thrust bearing as well as two radial bearings for a bearing arbor of the shift arm is set into a transverse bore formed in the extrusion profile. The axis of the bore extends slightly toward the wing plane as well as almost parallel thereto; it is inclined in such a manner that the swivel plane of the shift arm have a spatial position which deviates from a horizontal line.

It has proved beneficial for a mounting of the shift arm at the wing for easy action, if the thrust bearing lies between a shoulder of the bearing arbor and a shoulder of the bushing, while each one radial bearing is carried at the lower and the upper end between the bushing and the bearing arbor.

To improve the supporting contact of the bearing block at the front face of the wing, it has also been fond advantageous if a hook flange is formed on the upper side of the extrusion profile; a free leg of the hook flange ends flush with the outer surface of the rear wall of the extrusion profile.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
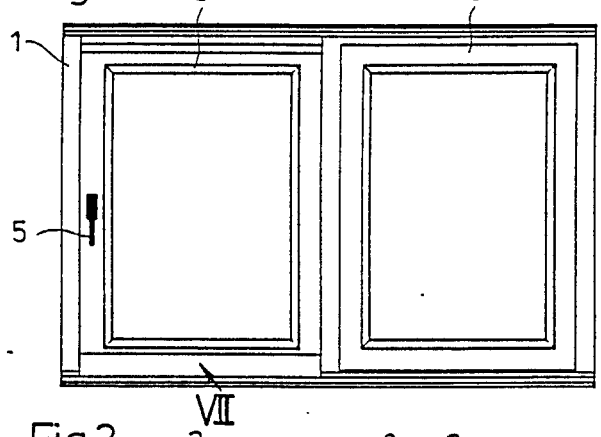
FIGS. 1 and 2 are front elevational and side elevational views, respectively, of a parallel stop tilt-slide window in the closed position of the wing.

FIGS. 1 to 6 of the drawing show a balcony or patio window which is mounted in a stationary frame 1 and has a fixedly-mounted wing 2 and a movable wing 3.

Figure 2:
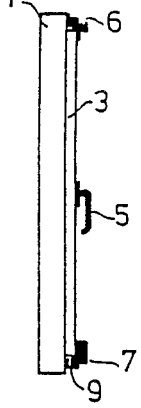
Figure 3:
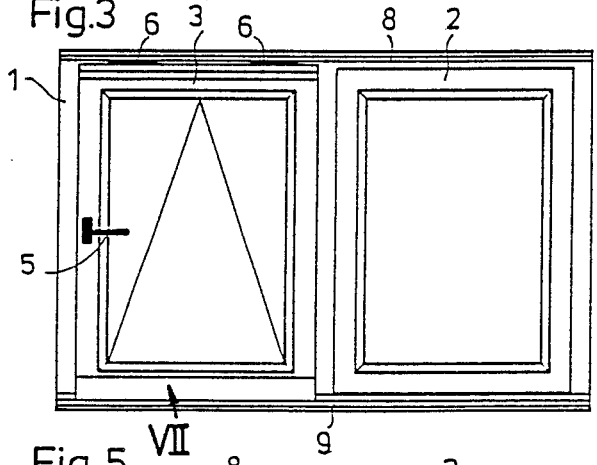
FIGS. 3 and 4 are front elevational and side elevation view, respectively, of the window with the wing open in tilt position.
Figure 4:
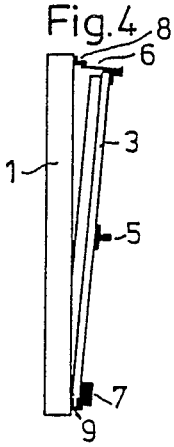
Figure 5:
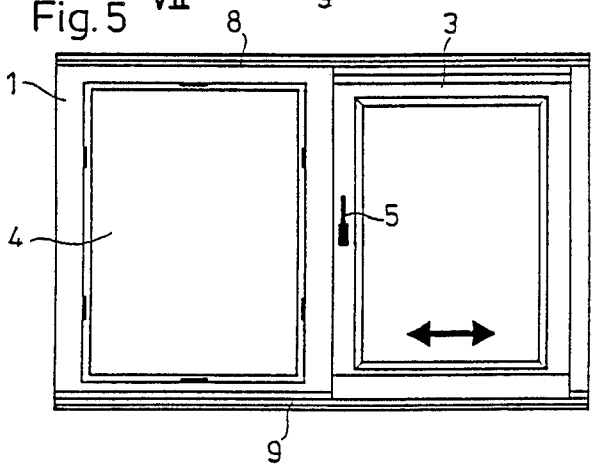
FIGS. 5 and 6 are front elevational and side elevational views, respectively, of the window with the wing in parallel stop position and moved horizontally into open position, FIG. 7 an elevation view of the mechanism installed in the region VII of FIGS. 1 to 4 on a larger scale and seen from the front.
Figure 6:
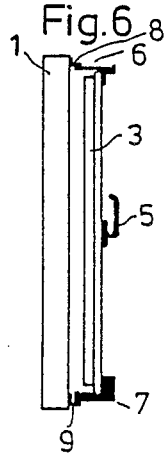

The movable wing 3 can be brought (relative to the stationary frame 1 and to the fixedly mounted wing 2) from the "closed" position indicated in FIGS. 1 and 2 into the "tilt" position, as can be seen in FIGS. 3 and 4. It can also be brought into a parallel stop position relative to the stationary frame 1 and the fixedly mounted wing 2 and can then be shifted in the horizontal direction from the region of the opening 4 of the stationary frame 1 to a position in front of the fixedly mounted wing 2, as is shown in FIGS. 5 and 6.

In order to make possible these three positions of the wing 3 (relative to the stationary frame 1) a special mechanism, namely a so-called "tilt-slide mechanism" is provided which can be seen simply in FIGS. 1 to 6. It consists of a control handle 5 at the wing 3, as well as the upper shift arm 6 and the lower shift mechanism 7 between wing 3 and stationary frame 1.

With regard to the kinematics, the upper shift arm 6 and the lower shift mechanism 7 may be similarly designed. The basic design of the upper shift arm 6 can, however, also be derived from such constructions as are used for windows or doors with tilting action or swinging action and are part of the art. It must merely be ensured that the frame-side pivotal points of these shift devices permanently engage a horizontal slide guide 8 at the upper transverse par of the stationary frame 1 and that a synchronous motion of its shift arms is ensured.

The lower shift mechanism 7 must at any rate be so designed that it reliably carries the weight of the movable wing 3, while it interacts with a guide rail 9 at the lower transverse beam of the stationary frame 1.

Of primary importance in the present case is the construction and mode of operation of the lower tilt-slide mechanism 7 whose functionally essential development can be seen in the FIGS. 7 to 13.

Figure 7:
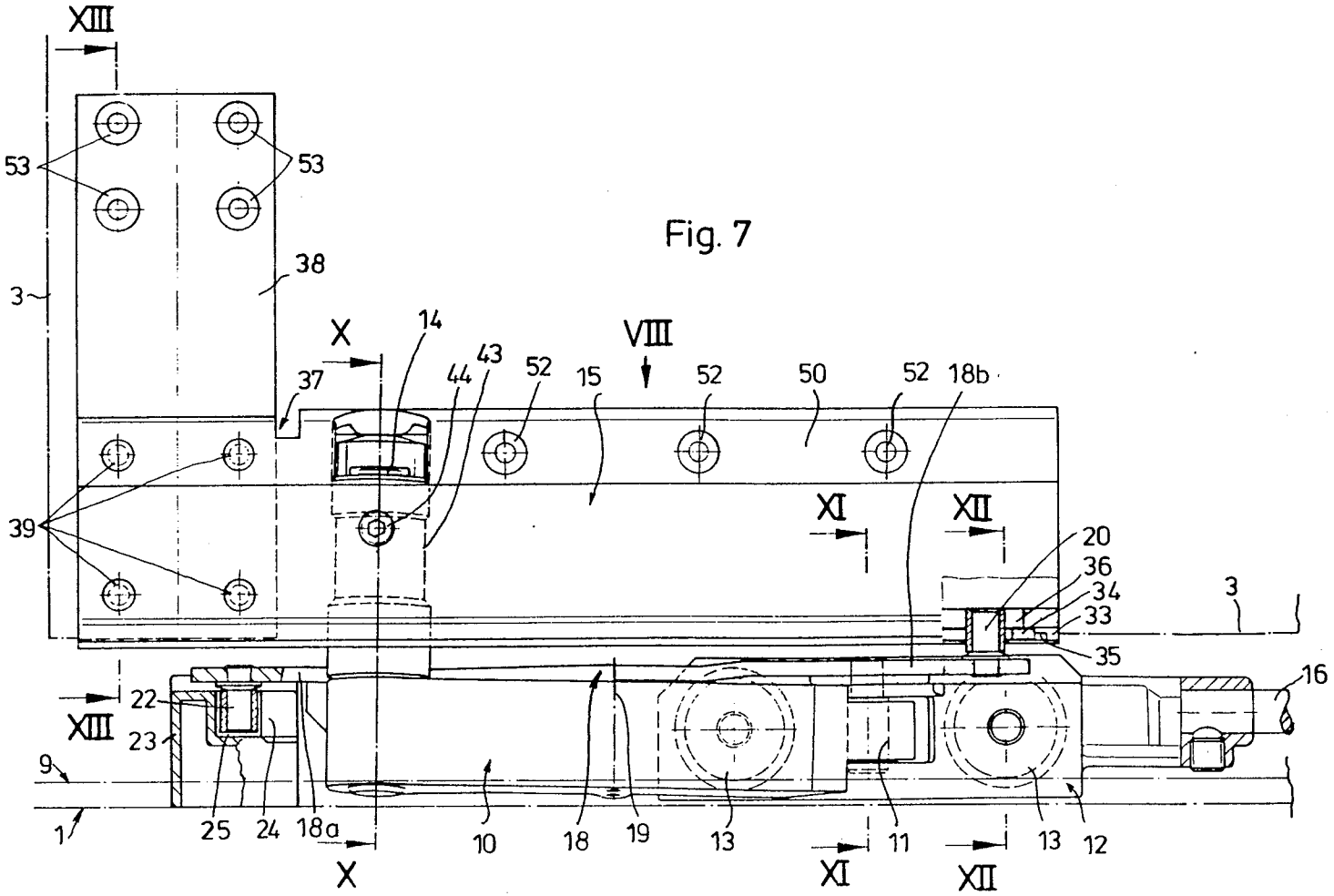
Figure 8:
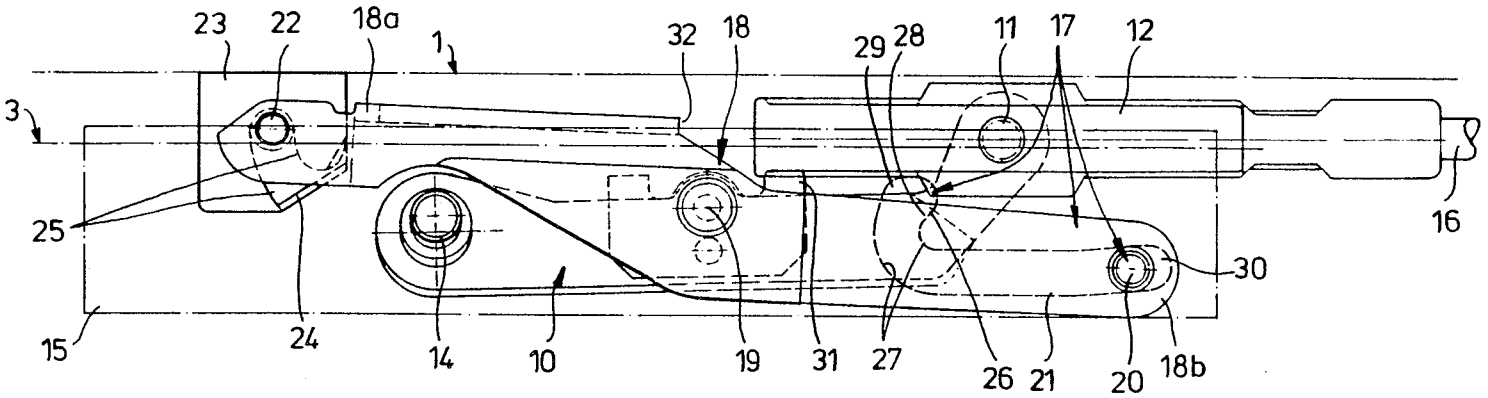
FIG. 8 shows the mechanism as viewed in the direction of the arrow VIII of FIG. 7.
Figure 9:
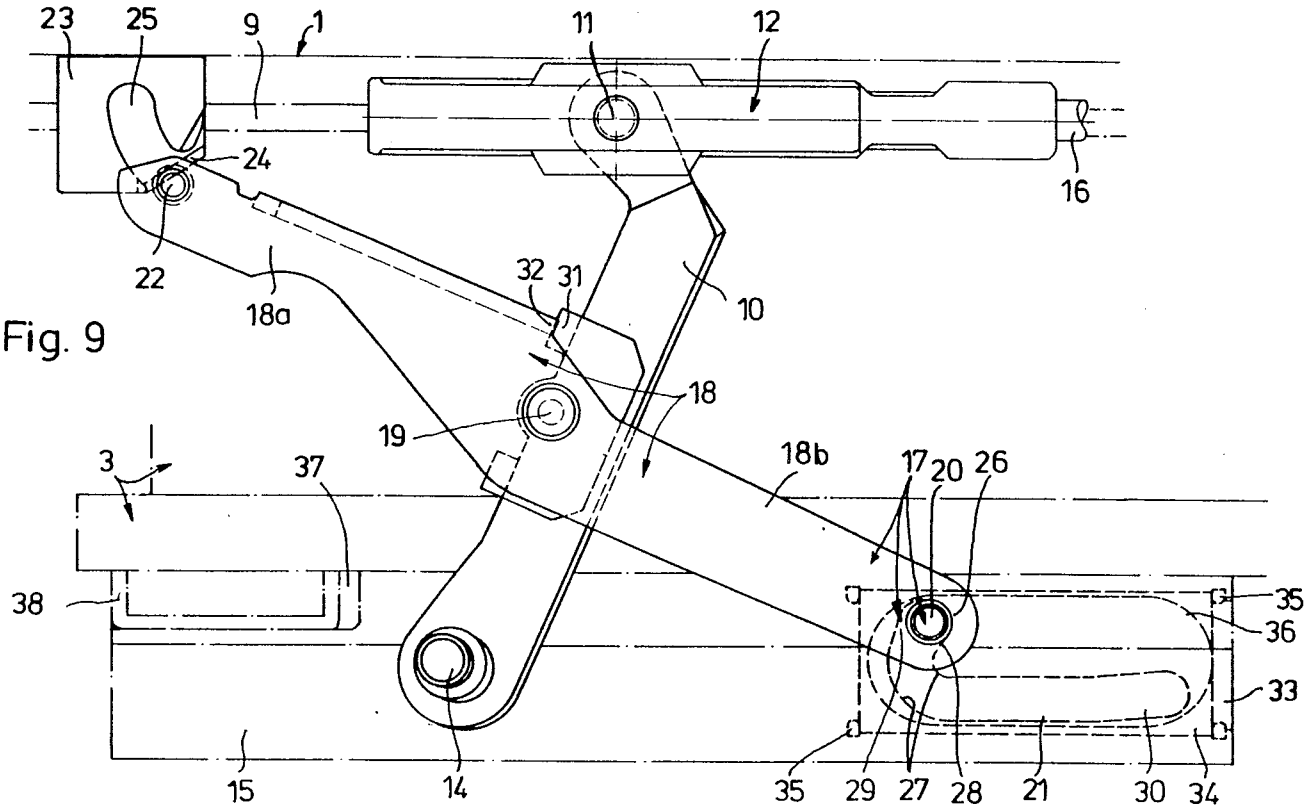
FIG. 9 is a plan view of the mechanism in its functional position corresponding to the FIGS. 5 and 6.

The tilt-slide mechanism 7 has at least two structurally similar shift arms 10 of which, however, only one is presented for simplicity's sake in FIGS. 7 to 9. Each of the shift arms 10 is swingably articulated about an essentially vertical pivot pin 11 on a traveling carriage 12. Each traveling carriage 12 is equipped with two rollers 13 that are mounted for free pivoting around essentially horizontal axes by which means the carriage is movably supported on the guide rail 9 of the stationary frame 1 parallel to its plane.

Figure 10:
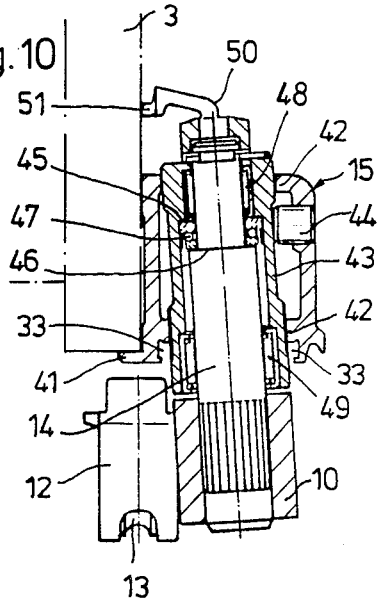
FIG. 10 is a sectional view taken on the line X—X of FIG. 7.
Figure 11:
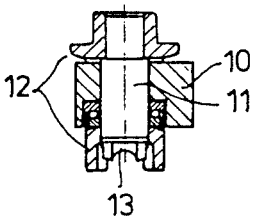
FIG. 11 is a sectional view taken on the line XI—XI of FIG. 7.

Each shift arm 10 bears at its other end a bearing arbor 14 which swingably engages a bearing block 15 fastened on the wing 3, as can clearly be seen in FIGS. 7 and 10.

The traveling carriages 12 carrying the shift arms 10 are firmly connected with one another through a coupling rod 16 which is only partly shown in FIGS. 7 to 9. By means of the coupling rod 16, the pivot pins 11 and the traveling carriages 12 of the tilt-slide mechanism 7 which carry them are permanently held at a constant spacing to one another.

Also the bearing arbors 14 of the two shift arms 10 are mounted in constant spacing to one another on the wing 3. The fixed bearing blocks 15 operate in such a manner that the wing 3 and the traveling carriages 12 form a guide parallelogram with the coupling rod 16 and the two shift arms 10. By means of this guide parallelogram, the wing 3 can be moved transversely of its own plane as well as transversely of the plane of the stationary frame 1 between the "closed" position shown in FIG. 8 and the "parallel stop" position evident in FIG. 9.

While the tilt-slide mechanism is in the condition shown in FIG. 8, it is possible to move the wing 3 out of the "closed" position corresponding to FIGS. 1 and 2 into the "tilt" position evident in FIGS. 3 and 4. The wing 3 can also be moved from the parallel stop position of the tilt-slide mechanism 7 (according to FIG. 9) horizontally into the open position (evident in FIGS. 5 and 6).

In order that the wing 3 remain, during its horizontal shift, continually in the parallel stop position relative to the stationary frame 1, it is necessary to lock the parallel stop position of the shift arms 10 relative to the stationary frame 11 and the traveling carriage 12 guided on its guide rail 9. This is accomplished by a special blocking device 17, which can be seen particularly well in FIGS. 8 and 9. On the other hand, it, is necessary that the blocking of the parallel stop position of the shift arms 10 be removed by releasing the blocking device 17 as soon as the wing 3 arrives at its "closing" position, so that it can move from the parallel stop position (according to FIG. 9) to the closed position in the opening 4 in the stationary frame 1 (indicated in FIG. 8).

For the sake of simplicity, the blocking device 17 is provided only between the lower shift arm 10 and the wing 3, as well as the stationary frame 1, although it would quite well be possible to provide such a blocking device 17 in the region of two shift arms 10 between wing 3 and stationary frame 1. Because of the enforced interaction of both shift arms 10 (in the manner of a guide parallelogram) it is fully sufficient to provide the releasable blocking device 17 only in the area of a single shift arm 10 between the wing 3 and the stationary frame 1.

The blocking device 17 has a supporting lever 18 which is swingably hinged only to the shift arm 10 around a bearing pivot pin 19. This is done approximately in the central area between the pivot pin 11 at the traveling carriage 12 and the bearing arbor at the bearing block 15.

The supporting lever 18 is designed as a two-armed lever with a lever arm 18*a* extending toward the stationary frame 1 and a lever arm 18*b* extending toward the wing 3.

At the end of the lever arm 18*b* the supporting lever 18 carries a guide pin 20 which is situated in the bearing block 15 and which engages a guide slot 21 for swinging and shifting. Also, the lever arm 18*a* of the supporting lever 18 the stationary frame 1 is provided with a pivot pin 22 as a control journal, which is associated with the fixed thrust bearing 23 mounted on the stationary frame 1 or on the guide rail 9.

The frame-side thrust bearing 23 has an entrance opening 24 for the journal 22 of the supporting lever 18 which serves as a control stud. The stud joins in the shift-and-lock movement of the wing 3 and a slot 25 that is curved relative to the stationary frame 1, as is evident in FIGS. 8 and 9.

The guide slot 21 is located on the wing 3 and on the bearing block 15 and is provided at the end associated with the "parallel stop" position of the wing 3 with a detent recess 26 adapted to receive the guide pin 20 of the lever arm 18*b* of the supporting lever 18. This provides a path curved relative to the stationary frame 1 and towards the traveling carriage 12; it has a guide curve 27 connecting the recess 26 with the guide slot 21.

The flank 28 of the detent recess 26 extends at an acute angle of less than 90° to the longitudinal direction of the guide slot 21, as may clearly be seen in FIGS. 8 and 9. The region of the detent recess 26 lies opposite the flank 28 and is designed with an enlargement 29, so that the guide pin 20 can engage the detent recess 26 with radial play in direction of that enlargement.

The end of the longitudinal slot 21 in the bearing block 15 is associated with the closed position of the wing 3 and has an obtuse-angled bend 30 which faces towards the stationary frame 1 and the traveling carriage 12.

When the wing 3 which abuts in closed position with the stationary frame 1, the guide pin 20 of the supporting lever 18 is located in the range of the obtuse-angled bend 30 of the guide slot 21. Simultaneously, the pin 22 lies in the range of the end of the curved slot 25 which faces towards the stationary frame 1 at the thrust bearing 23, as can be seen in FIG. 8.

The length ratios (on the one hand) of the shift arm 10 between its pivot pin 11, and its bearing arbor 14, and the interposed pivot pin 19 for the supporting lever 18, as well as (on the other hand) the length ratios of the supporting lever 18 between the guide pin 20, the pin 22, and the pivot pin 19 are selected, so that during the parallel stop movement of the wing 3 from the position of FIG. 8 into the position of FIG. 9 there is developed quite a forced movement of the supporting lever 18. In the meantime, the guide pin, 29 of its lever arm **18*b* shifts lengthwise within the guide slot 21 on the wing. As long as the guide pin 20 has not yet reached the guide curve 27 ahead the detent recess 26, the supporting lever 18 on its spread movement relative to the shift arm 10 is so guided that the pin 22 of its lever arm 18*a* remains practically always in the proximity of the end of the curved slot 25 adjacent the stationary frame 1 in the thrust bearing 23. In the meantime, the wing 3 is locked through the supporting lever 18 relative to the stationary frame, so that it is held firmly against a horizontal displacement from the region of the opening 4** from which the wing came.

Only when the guide pin 20 in the guide slot 21 strikes the guide curve 27 lying ahead of the detent recess 26, is the supporting ever 18 gradually pivoted around the bearing pin 19 at the shift arm 10 and the pin 22 of its lever arm 18 moves into the region of the entry opening 24 of the thrust bearing 23 and can thereby detach itself from the thrust bearing 23. However, at this moment the guide pin 20 has already moved into the detent recess 26 and locates itself at its flank 28 which extends at an acute angle to the plane of the wing. In that way the blocking device 17 enters into form-locking engagement and supports the shift arm 10 at the wing 3 and at its bearing block 15 to prevent it from turning back around its bearing arbor 14. In that way, the parallel stop position of the wing 3 relative to the stationary frame 1 and to the carriage 12 (traveling upon its guide rail 9).is effectively locked.

The operation has especially proved to be effective when the flank 28 of the detent recess 26 has a path which coincides with that of the swivel arc of the guide pin 20 around the bearing pin 19 on the shift arm 10. This is when the shift arm 10 takes up (relative to the wing 3) the angular position around the bearing arbor 14 which corresponds to the "parallel stop" position.

In order to improve the functional reliability of the blocking device 17, it has further proved beneficial if the supporting lever 18 is braced against the shift arm 10 by a spring element, such as a plate spring 31; this is done in such a manner that a stop 32 at the lever arm **18*a* of the supporting lever 18 strikes against the plate spring at approximately the moment when the guide pin 20 of the lever arm 18*b* has reached the guide curve 27 of the guide slot 21. In that way, the plate spring 31 can impart to the supporting lever 18 an actuating impulse which presses the guide pin 20 of the lever arm 18*b* into the detent recess 26 and actuates the blocking device 17** in the blocking mode.

To insure that the wing 3 cannot move with its lower transverse beam into parallel stop position relative to the stationary frame when it is to be opened in the tilt position, there are provided special locking devices of the tilt-shift mechanism located between the lower horizontal beam of wing 3 and stationary frame 1. These devices engage one another, so that they limit the shift motion of the wing 3 transversely of its plane relative to the stationary frame 1 to only the minimum amount needed for the tilt motion. These blocking devices can be designed in the manner that is customary for tilt-locks for the so-called "tilt-turn" windows and doors.

Figure 13:
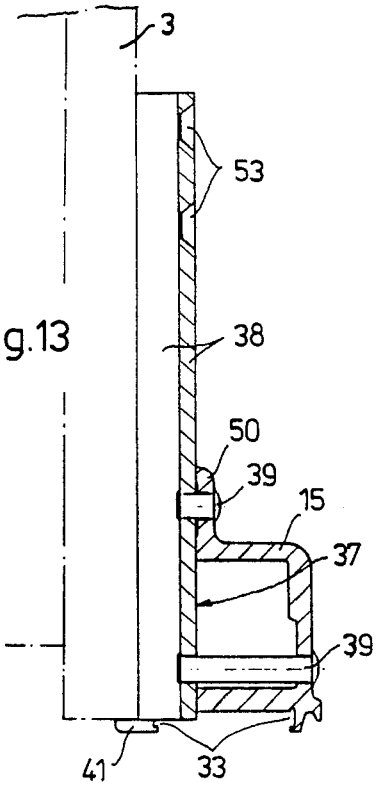
FIG. 13 ia a sectional view taken on the line XIII—XIII of FIG. 7.
Figure 12:
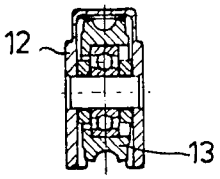
FIG. 12 is a sectional view taken on the line XII—XII in FIG. 7.

FIGS. 7, 10, and 13 of the drawings particularly show that the bearing blocks 15 for the shift arms 10 can be fabricated from a tubular extrusion profile having an essentially polygonal shape, especially with a rectangular or square cross-section. This extrusion profile can advantageously be made of a light metal. At its bottom longitudinal surface the bearing block 15 is formed with an undercut, profiled, one-sided open channel 33 into which is inserted a plate 34, which contains the guide slot 21 formed with the bend 30, the guide curve 27, and the detent recess 26. The plate 34 can be tightly clamped within the undercut channel 33 in a predetermined position, since the undercut areas are provided with indentations 35. In the installation zone of the plate 34, the extrusion profile (which forms the bearing block 15) can be provided with a relief recess, such as a milling 36, which permits a sufficiently deep engagement of the guide pin 20 in the guide slot 21, as may best be seen in FIG. 7.

It is also conceivable that the plate 34 could be fixed against shifting by means of screws or pins which engage holes in the plate 34 and are braced against the edges of the recess milling 36.

One end of the extrusion profile, forming the bearing block 15, is provided with a notch 37 which penetrates the rear profile wall. A transverse leg 38 of U-shaped cross-section engages the notch at one end, and is connected through a rivet 39 to the bearing block 15 to an angle piece which can be fastened upon the front face of the wing 3 by means of screws. Rim webs 41 are formed integrally of the bearing block 15 and act as supports and alignment elements to overlap the peripheral areas of the wing 3, as is indicated in FIGS. 10 and 13. Also, the transverse leg 38 with its U-shaped cross-section can be made as an extrusion profile.

Into bores 42 which penetrate both the lower and the upper walls of the bearing block 15 is inserted a bushing 43 which is additionally fixed in position by a clamping screw 44. The longitudinal axis of this bushing 43 has (inside the bearing block 15) an inclined position relative to the plane of the wing, as may clearly be seen in FIG. 10.

The longitudinal axis of the bushing lies at less distance from the wing plane at its upper end than its lower end.

FIG. 7 also shows that the bushing lies in the bearing block 15 in the direction generally parallel to the plane of the wing, but with a slight inclined position in the bearing block. The lower end of the bushing 43 lies somewhat closer to the adjacent wing corner than its upper end.

The bearing arbor 14 is non-rotatively connected to the shift arm 10 and projects from below into the bushing 43. Between a supporting shoulder 45 of the bushing 43 and an opposite supporting shoulder 46 of the bearing arbor 14 is mounted an axial thrust bearing 47. Between the upper end of the bushing 43 and the bearing arbor 14 is arranged a radial bearing 48; a similar radial bearing 49 is located also between the lower end of the bushing 43 and the bearing arbor 14.

While the axial thrust bearing 47 is formed as a ball bearing, it has been found advantageous to select the radial bearings 48 and 49 in the form of needle bearings.

On the upper wall of the bearing block 15 is formed an integral hook flange 50 whose free leg 51 ends flush with the outside surface of the rear wall of the extrusion profile; it is, therefore, additionally braced against the front face of the wing 3. In the vicinity of the hook flange 50 are provided counterbores 52 which receive the fastening screws for the bearing block 15. Similar counterbores 53 are situated in the upper end of the transverse leg 38, so that this can be connected with the wing 3 by fastening screws. Finally, it should be mentioned that the cross-sectional height of the U-shaped, profiled transverse leg 38 is relatively small, and, preferably, lies lower than the cross sectional height of the hook flange 50 by a wall thickness.

It is obvious that minor changes may be made in the form and construction of the invention without departing from the material spirit thereof. It is not, however desired to confine the invention to the exact form herein shown and described, but it is desired to include all such as properly come within the scope claimed.

The invention having been thus described, what is claimed as new and desired to secure by Letters Patent is:

1. Tilt-slide mechanism for a wing of a window or door which can be stopped in parallel positions and in this position can be shifted horizontally relative to a stationary frame, the mechanism having lower shift arms (10) and upper shift arms, at least one of the lower shift arms (10) being pivotally mounted to a lower transverse wing beam and to a traveling carriage (12), which shift arm can be brought in and out of a work connection by a control pivot pin (22) with a thrust bearing mounted on the stationary frame by means of the displacement motion of the wing, characterized by the fact that a supporting lever (18) has a lever arm (18) swingably hinged by a pivot pin (19) on the shift arm (10) in the area between a pivot pin (11) on the traveling carriage (12) and a pivot pin (14) on the wing, the lever arm (18) engaging a guide pin (20) so as to be swingably shiftable, the lever arm being connected to the wing in a guide slot (21) located on the wing, the guide slot being provided at one end with a detent recess (26) for the guide pin (20), while a second end of the lever arm is provided with the control pivot pin (22) which can be brought by a shift-and-lock motion of the wing into a work connection with the thrust bearing (23) mounted on the stationary frame, and said lever arm is therewith fixed so as to be placed in blocking engagement by the guide slot (21).

2. Tilt-slide mechanism as recited in claim 1, wherein the detent recess (26) of the guide slot (21) has, relative to the traveling carriage (12) or to the stationary frame, an acute-angled inclined position.

3. Tilt-slide mechanism as recited in claim 2, wherein the thrust bearing (23) has an entry opening (24) for the control pivot pin (22), which pin takes part in the shift-and-lock movement of the wing, to a cam slot (25) which is curved relative to the stationary frame.

4. Tilt-slide. mechanism as recited in claim 3, wherein the wing is lockable with its beam adjacent to the traveling carriage (12) and relative to the stationary frame to prevent a lifting motion transversely of its plane by means of tip-locking devices of a tip-parallel-stop-shift fitting.

5. Tilt-slide mechanism as recited in claim 4, wherein the supporting lever (18) is equipped with two lever arms **(18*a*, 18*b*) and is braced against the shift arm (10) by a spring (31) in the parallel stop position (32)**.

6. Tilt-slide mechanism as recited in claim 5, wherein the spring element (31) is the form of a plate which sits in the proximity of the pivot pin (19) of the supporting lever **(18,18*a*,18*b*) at the shift arm (10)**.

7. Tilt-slide mechanism as recited in claim 6, wherein the bearing block (15) for the shift arm (10) and the blocking device (17) consists of a tubular extrusion profile which contains in its lower longitudinal side an undercut, profiled, open-sided open channel (33) into which can be inserted a plate (34) containing the guide slot (21) for the supporting lever **(18,18*a*,18*b*)**.

8. Tilt-slide mechanism as recited in Cladim 7, wherein the plate (34) having the guide slot (21) is lockable in the channel (33) to prevent longitudinal displacement .

9. Tilt-slide mechanism as recited in claim 8, wherein the bearing block (15) for the shift arm (10) and the blocking device (17) is provided at one end with a release (37) which engages a transverse leg (38) of U-shaped cross-section which is connectable with the extrusion profile to form an angle piece (40).

10. Tilt-slide mechanism as recited in claim 9, wherein the bearing block (15) for the shift arm (10) and the blocking device (17) is provided at one end with a release (37) which engages a transverse leg (38) of U-shaped, cross-section which is connectable with the bearing block to form an angle piece (40).

11. Tilt-slide mechanism as recited in claim 10, wherein the axial thrust bearing (47) lies between one shoulder (46) of the bearing arbor (14) and one shoulder (45) of the bushing (43) and with a radial bearing (49 and 48) is mounted at the lower and the upper end between the bushing (43) and the bearing arbor (14).

12. Tilt-slide mechanism as recited in claim 11, wherein upon the upper side of the bearing block (15) is formed with a hook flange (50) whose free leg (51) ends flush with the outside surface of the rear wall of the bearing block.

* * * * *